United States Patent [19]

Baugh

[11] 4,082,074

[45] Apr. 4, 1978

[54] MECHANICAL ENGINE GOVERNOR WITH VARIABLE LIMITING SPEED SETTING

[75] Inventor: Edward D. Baugh, Union Lake, Mich.

[73] Assignee: General Motors Corporation, Detroit, Mich.

[21] Appl. No.: 700,292

[22] Filed: Jun. 28, 1976

[51] Int. Cl.[2] ..... F02D 1/12

[52] U.S. Cl. ..... 123/140 FG; 123/140 MC

[58] Field of Search ..... 123/140 MD, 140 MC, 123/140 R, 140 FG

[56] References Cited

U.S. PATENT DOCUMENTS

| | | | |
|---|---|---|---|
| 2,669,983 | 2/1954 | Reddy et al. | 123/140 R |
| 2,771,788 | 11/1956 | Frick et al. | 74/860 |
| 2,875,635 | 3/1959 | Fleck et al. | 74/860 |
| 3,077,873 | 2/1963 | Parks et al. | 123/140 MP |
| 3,125,086 | 3/1964 | Foxet al. | 123/140 R |
| 3,805,669 | 4/1974 | Mitchell | 91/178 |
| 3,886,922 | 6/1975 | Frick | 123/140 R |

*Primary Examiner*—Charles J. Myhre
*Assistant Examiner*—Tony M. Argenbright
*Attorney, Agent, or Firm*—Robert J. Outland

[57] ABSTRACT

A limiting speed mechanical engine governor has a speed responsive fuel decreasing mechanism opposed by a high speed spring, the effective force of which controls the maximum governed speed of the engine. A speed adjuster, such as an air actuated piston, is arranged to act against the operative end of the high speed spring to controllably reduce its preset speed setting force and thus provide for controlled reduction of the maximum governed speed of the engine. A control system is disclosed for use on a vehicle, such as a diesel engine powered truck, to permit using the variable maximum speed capability of the governor as a road speed control for the vehicle or to provide a reduced controlled engine speed for operating engine driven accessories when the vehicle is stationary.

6 Claims, 4 Drawing Figures

MECHANICAL ENGINE GOVERNOR WITH VARIABLE LIMITING SPEED SETTING

CROSS REFERENCE TO RELATED APPLICATION

In addition to the governor disclosed and claimed herein, this application also discloses a vehicle engine speed control system incorporating the governor, which control system is the joint invention of Warren L. Moody and Edward D. Baugh and is disclosed and claimed in their co-pending U.S. patent application Ser. No. 715,984, filed Aug. 19, 1976 and assigned to the assignee of the present invention.

BACKGROUND OF THE INVENTION

This invention relates to mechanical engine governors for internal combustion engines and, more particularly, to the provision of speed adjusting means for reducing the maximum controlled engine speed, as desired by the operator. In its more specific aspects, the invention relates to the provision of a variable maximum speed-idle speed mechanical governor for use on diesel engines for automotive vehicles in conjunction with a system to permit use of the governor as a road speed control for the vehicle or as a means for regulating engine speed while driving accessories when the vehicle is stationary.

It is known in the art relating to governors for internal combustion engines, particularly for compression ignition engines, to provide a mechanical governor having means for controlling the engine idle speed, as well as for preventing operation above a preset maximum speed or range or speeds. One type of governor used for such purposes has centrifugal flyweights which act through a linkage against an idle speed spring and, upon its full compression, on a high speed spring which controls maximum engine speed. Between the preset idle and maximum speeds, the fuel input is controlled manually by the operator of the engine or vehicle, with the speed controlling function of the governor coming into play only to prevent the engine from operating below its idle speed or above its preset maximum speed.

In certain applications, particularly vehicle applications of engines having governors of the abovementioned type, there has been a need to provide some means for automatically controlling the engine speed at an intermediate level for operating accessories that might be driven by the engine while the vehicle is stationary. Numerous arrangements have been made for accomplishing this purpose and in some cases modifications of the basic governor design have been made. While some such arrangements have been useful, it is believed that none have accomplished the desired purpose in the manner of the present invention. Further, there has been an increasing need to provide in conjunction with automotive vehicles an adjustable road speed control. In the past, this function has been accomplished by the use of a separate vehicle speed governing device.

SUMMARY OF THE INVENTION

The present invention provides for a relatively simple modification of a previously known mechanical engine governor arrangement which, in combination with a suitable actuating and control mechanism - preferably air operated, provides an arrangement wherein the engine governor may be utilized as a vehicle road speed control, as well as providing a controllable maximum speed capability for operating engine driven accessories as well as performing its usual idle speed and maximum speed controlling functions for normal vehicle operation. These and other advantages of the invention, as well as a full understanding of its features, will be gained from the following description of certain preferred embodiments taken together with the accompanying drawings.

Figure 1:
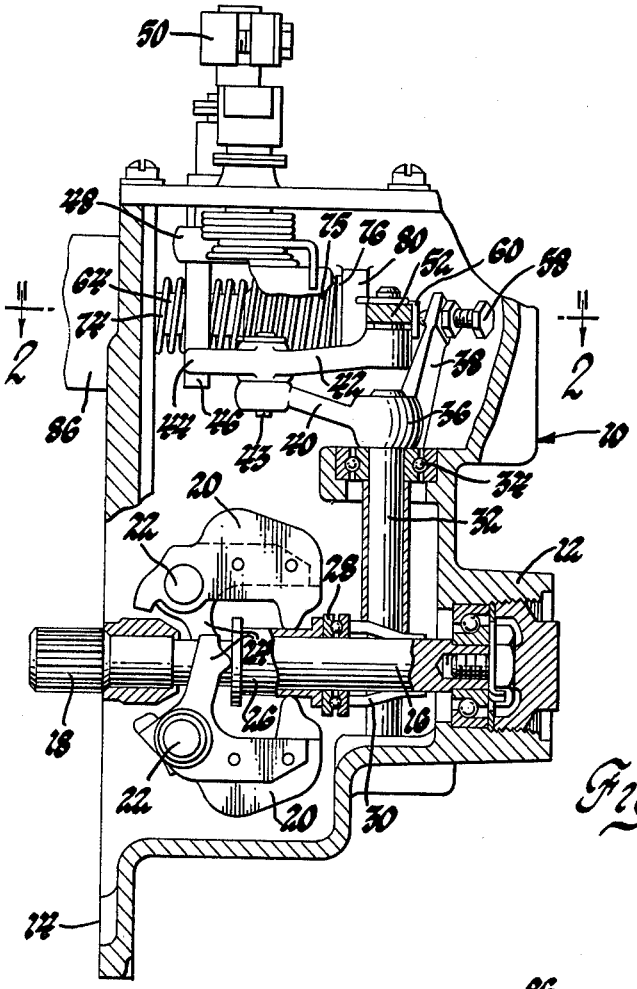
FIG. 1 is a cross-sectional view of a portion of the mechanism of a mechanical engine governor formed according to the invention.
Figure 2:
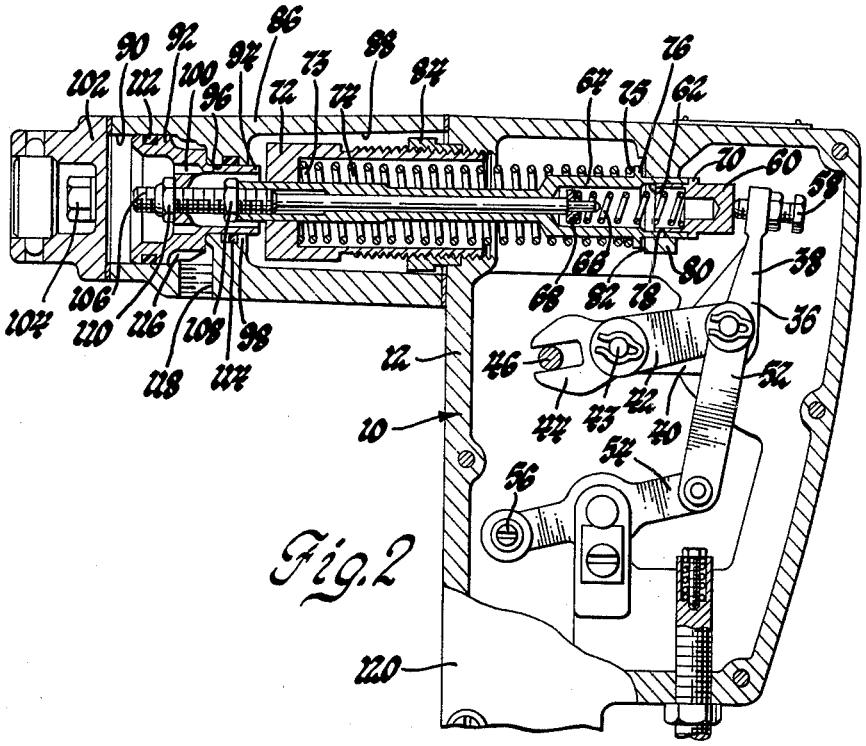
FIG. 2 is a cross-sectional view of the governor of FIG. 1 taken generally in the plane indicated by the line 2—2 of FIG. 1.

DESCRIPTION OF FIGS. 1 and 2

Referring now to FIGS. 1 and 2 of the drawings in detail, numeral 10 generally indicates a mechanical engine governor for a compression ignition engine and including a housing 12 having a mounting surface 14 which is adapted to be secured to the end face of the blower housing or other suitable portion of a compression ignition engine.

Within the housing 12 is a rotatable shaft 16, having a splined end portion 18 that is adapted to be connected to the rotating blower shaft, or other suitable portion of the engine, for driving the shaft 16 at a speed proportional to engine speed. Shaft 16 carries a pair of pivotally mounted flyweights 20 which, upon increasing speed, are increasingly urged outwardly by centrifugal force around pivots 22. Fingers 24 extending from the flyweights engage a sleeve 26 which acts through a bearing 28 on an operating fork 30. The fork 30 is connected to an operating shaft 32 that is mounted for oscillation in bearings, only one 34 of which is shown. Operating shaft 32 is fixed to an operating shaft lever 36, having a pair of angularly disposed arms 38, 40.

At the end of arm 40 of the operating shaft lever, a differential lever 42 is pivotably mounted intermediate its ends on a pivot pin 43. One end of arm 42 is bifurcated at 44 to receive the end of a pin 46 extending from operating mechanism 48, which is adapted to be connected through an external lever 50 with the accelerator pedal, not shown, of a vehicle or other means for manual control of the engine by the operator. At its other end, differential lever 42 is pinned to a link 52, which is in turn connected to an oscillating lever 54 having an end portion 56 connectable with engine fuel rack actuating means, not shown, for moving the engine injector racks between their maximum and minimum fuel positions.

The other arm 38 of operating shaft lever 36 carries an adjusting screw 58 which engages a cup-shaped cap 60, carried for reciprocation within a recess 62 of a cylindrical plunger 64. A low (idle) speed spring 66 extends between the cap 60 and a seat 68, operatively connected to the plunger 64 by adjustable means for setting the spring preload. A flange stop 70 on the cap 60 is engagable with the end of the plunger 64 to limit compression of the spring 66 and provide a solid connection thereafter between the lever 36 and plunger 64.

An adjustable cup-like retainer 72 surrounding one end of plunger 64 receives and supports an adjustably fixed end 73 of a high speed spring 74. The other, or operative, end 75 of the spring 74 acts against a flange 76 on the plunger 64, biasing the plunger to the right, as viewed in FIG. 2. Plunger 64 is reciprocably supported in a bore 78 of a support member 80 which forms a portion of the housing 12. An annular abutment 82 surrounds the bore 80 and is located in opposition to the flange 76 of the plunger, which is biased toward the abutment by the high speed spring 74.

It will be noted that retainer 72 is threadably retained in the housing 12 so that its adjustment causes a longitudinal movement of the normally fixed end 73 of the spring 74. This changes the preload setting or force of the operative end 75 of the spring on the plunger flange 76 which determines the normal maximum speed setting for the governor. A nut 84 is provided to lock the retainer 72 in its normally fixed position after the proper adjustment has been made.

The portions of the governor mechanism so far described are substantially the same as or equivalent to the corresponding portions of certain previously known governors on which the governor of the present invention is based. One such governor is shown for example in U.S. Pat. No. 3,886,922 Frick, which was granted June 3, 1975 to the assignee of the present invention. However, the Frick governor also includes the application of a peak load control spring not shown in the governor arrangement so far described. It should be recognized that such a spring could be utilized in the arrangement of the present invention, if desired.

THE SPEED ADJUSTING MEANS

The present invention differs from the various prior art arrangements in the provision of simple but effective speed adjusting means capable of introducing a variable biasing force acting against the operative end of the high speed spring 74 to permit variable reduction of the preset maximum speed setting of the governor.

In FIGS. 1 and 2, the added or modified components include a combined cover and cylinder member 86, which is mounted on the housing 12 and encloses the retainer 72 and its lock nut 84 within a recess 88 at one end. A second recess 90 defines a cylinder in which there is reciprocably received a speed adjusting piston 92. A reduced diameter portion 94 of the piston extends through and substantially fills an opening 96 extending through a wall 98 between the two recesses 88 and 90. The recesses are connected by an internal passage 100 through the piston 92.

The end of the cylinder 90 is closed by a cover 102, screws 104 being utilized to hold the cover 102 and member 86 in assembly with the housing 12. As shown, cover 102 includes a plug and pin arrangement of the sort shown in U.S. Pat. No. 3,893,441 Hebb, Jr. et al, granted July 8, 1975 to the assignee of the present invention and provided for the purpose of resisting tampering with the governor speed settings by unauthorized personnel.

Piston 92 is secured to the outer end of the governor cylindrical plunger 64 by means of a threaded stud 106. This stud is threaded into the end of the plunger and locked in place by a nut 108. Engagement of the stud with the rod-like end of spring seat 68 provides the previously mentioned operative connection between the spring seat 68 and plunger 64. A second adjusting nut 110 secures the piston on the stud and permits the piston to apply a force againtst the plunger member in a direction opposing the biasing force of the operative end 75 of the high speed spring 74 against the plunger.

Annular seals 112 and 114, contained respectively in the piston 92 and the wall 98, seal the ends of an annular chamber 116 that is defined between the inner ends of the piston and the cylinder. A threaded opening 118 is provided, connecting the chamber 116 with the exterior of the cylinder member 86 to provide for connection of an air line to supply air at controlled pressures to the chamber 116.

GOVERNOR OPERATION

The operation of the governor arrangement of FIGS. 1 and 2 as above described is as follows.

When its associated engine is in operation, the shaft 16 of the governor will be rotated at a speed proportional to engine speed, causing the flyweights 20 to move outwardly and apply a force that increases with increasing engine speed and tends to rotate the operating shaft lever 36 in a counterclockwise direction as viewed in FIG. 2. Such movement of the speed responsive means (which includes lever 36) moves the pivot pin 43 downwardly, causing the differential lever 42 to swing in a clockwise direction, as shown in FIG. 2, around the pin 46. This movement in turn moves the internal actuating means comprising link 52 and lever 54 in a direction tending to move the external fuel rack actuating mechanism, not shown, of the engine toward the minimum fuel position.

The force generated by the flyweights is opposed initially by the bias of low speed spring 66, the force of the high speed spring 74 being sufficient at normal operating speeds to hold the plunger flange 76 in engagement with the abutment 82, so that the plunger is in its farthest rightward position, as shown in FIG. 2. At idle speeds, the low speed spring 66 extends cap 60 against the adjusting screw 58 in the lever 36 and controls the engine idle speed by yielding or extending as necessary to permit the fly-weight force to control fuel flow at the required amount for maintaining idle speed.

Actuation of the foot throttle or accelerator of the vehicle by the operator to increase speed moves the lever 50 so that pin 46 is moved generally downwardly, as shown in FIG. 2, pivoting lever 42 and the internal actuating means toward a fuel increasing position of increased injector rack (assuming a diesel engine is involved). The resultant speed increase causes an increase in force from the flyweights which completely compresses spring 66, causing the stop flange 70 of the cap 60 to engage the end of plunger 64, thus providing a nonyieldable connection between the lever 36 and the plunger.

Between idle and the maximum controlled engine speed, the rack position is set manually by the engine operator. However, when the maximum controlled speed range is reached, the force of the flyweights 20 becomes high enough to begin comprising the high speed spring 74, which yields as necessary to reduce the engine injector output by moving the injector racks toward the minimum fuel position so that the maximum controlled speed is not exceeded.

VARIABLE LIMITING SPEED OPERATION

In accordance with the present invention, the governor speed adjusting piston 92 may be utilized to controllably reduce the maximum operating speed of the engine from that of the maximum governed speed by applying a fluid pressure, such as air pressure, through the opening 118 to the chamber 116, where the fluid pressure acts against the piston 92 urging it leftwardly as shown in FIG. 2. The force of the pressurized fluid on the piston is in turn transmitted to the plunger 64 which, acting through the flange 76, applies this force against the operative end of the high speed spring 74. This reduces the portion of the force of the high speed spring which may be utilized to oppose the action of the governor speed responsive mechanism. Accordingly, as the force of the fluid pressure on speed adjusting piston 92 is increased, the speed at which the governor speed responsive mechanism will overcome the biasing force of the high speed spring becomes lower and lower and, accordingly, the maximum controlled operating speed of the engine becomes lower. Thus, the maximum governed engine speed may be controlled at will by the operator through the provision of suitable means for applying a controlled pressure in the chamber 116 to act upon the speed adjusting system 92. Further, upon removal of such fluid pressure, the governor will be returned to its normal operating condition.

It is noted that with the particular form of speed adjusting arrangement provided wherein the speed reducing biasing force is applied directly on the operative end of the high speed spring, the forces acting on the high speed spring are not increased by the application of fluid pressure against the piston 92. Instead, this biasing force merely acts to reduce the added force which the speed responsive mechanism of the governor must apply in order for the normal speed controlling action of the governor to take effect. In its also noted that the piston 92 and seals 112 and 114 should be designed to minimize sliding friction, since any friction caused by their movement in the cylinder will cause hysteresis in the governor speed control.

DESCRIPTION OF FIG. 3

Figure 3:
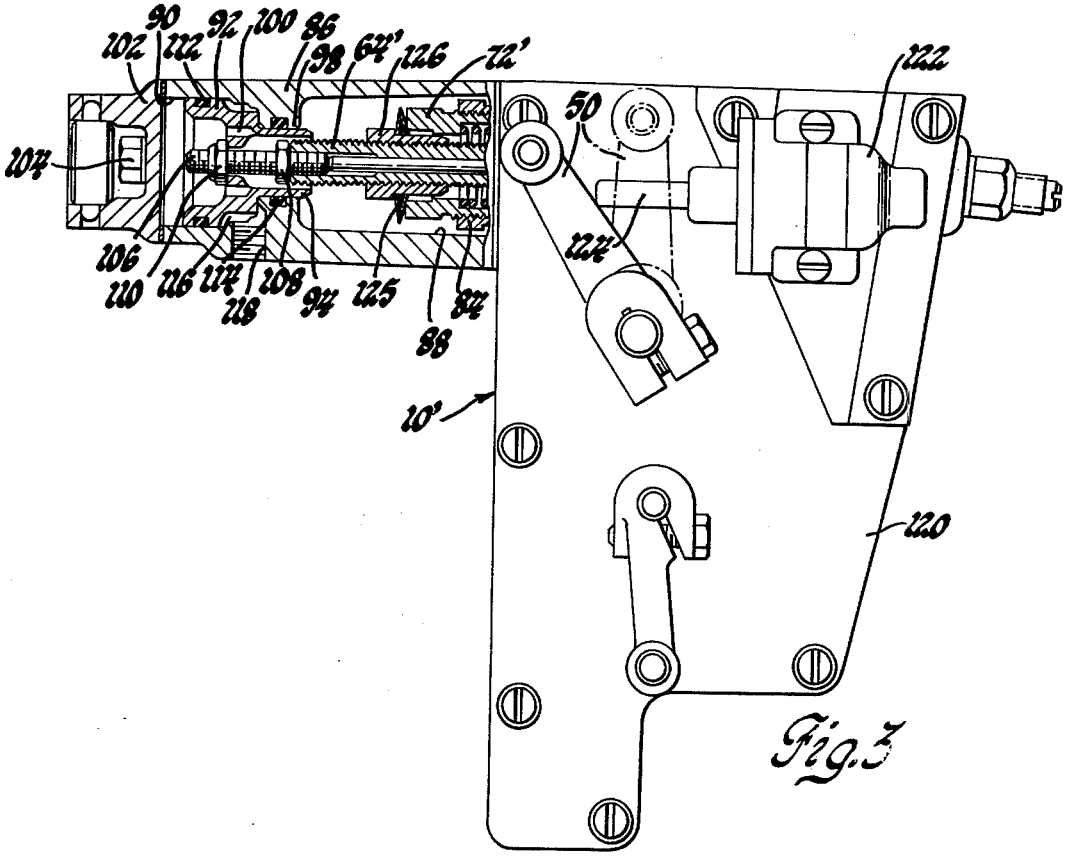
FIG. 3 is a top view partially in section of an alternative embodiment of governor formed according to the invention and showing certain additional features common to both embodiments.

Referring now to FIG. 3 of the drawings, there is shown an alternative embodiment of governor formed according to the present invention. In most of its aspects, the arrangement of the embodiment of FIG. 3 is the same as that of the previously described embodiment. Accordingly, like numerals are used to identify like parts while primed numerals identify modified components. The figure shows, in addition, the provision on the cover 120 of an air cylinder 122 having a plunger 124 which, when the cylinder is engerized, acts against the fuel controlling lever 50 of the governor to move the lever to its maximum fuel position. Although not shown in the drawings, the embodiment of FIGS. 1 and 2 of this cylinder mechanism may also be applied to that embodiment in order to hold the throttle of the governor in the maximum fuel position during the time when air pressure is applied to the speed adjusting mechanism of the governor to produce a controlled engine speed.

The mechanism of the FIG. 3 embodiment differs from that of the previously described embodiment in the provision of a peak load control spring mechanism formed by spring washers 125 acting between the modified retainer 72' and an adjusting nut 126 mounted on the threaded exterior of the modified plunger 64' to provide a peak load control function substantially like that of the previously mentioned Frick patent. This portion of the embodiment does not form a part of the present invention, but is included only to show applicability of the present invention to this form of modified peak load control governor.

DESCRIPTION OF FIG. 4

Figure 4:
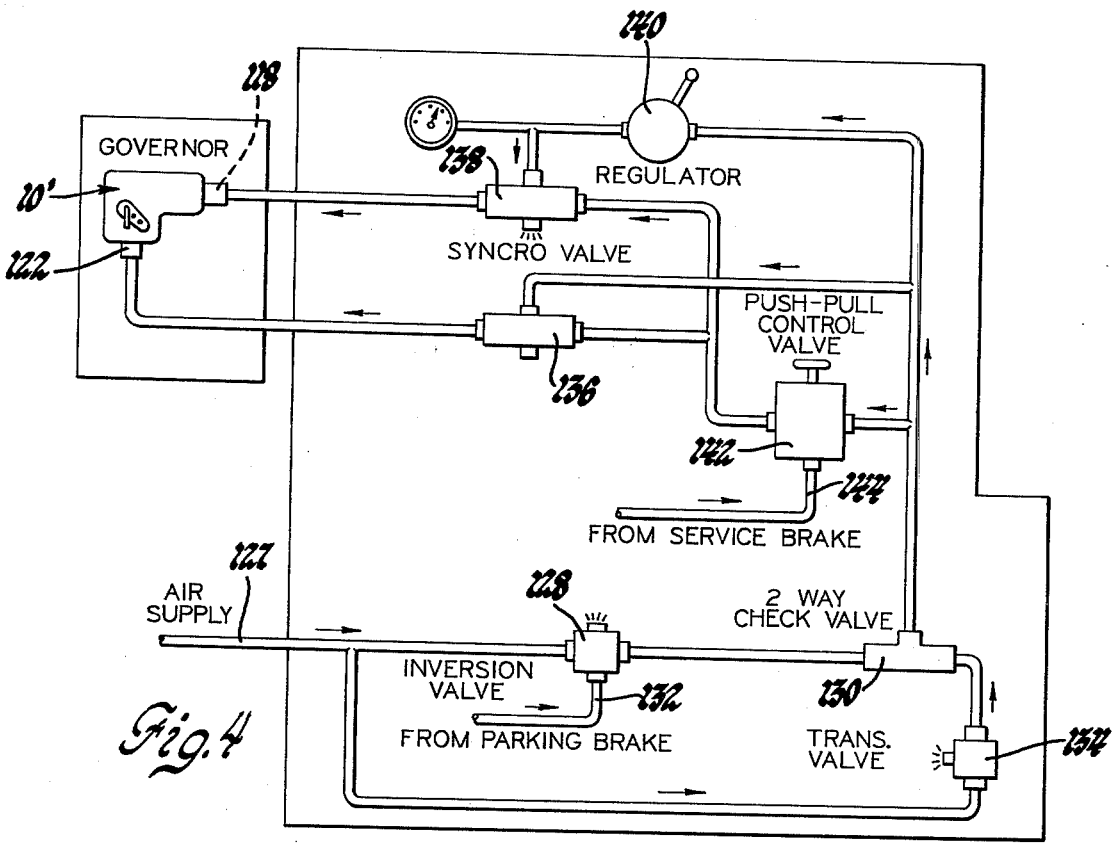
FIG. 4 is a diagrammatic view illustrating an air actuated system connected with a governor according to the present invention and arranged to provide in a vehicle the desired features of road speed control and controlled variable speed engine drive of accessories when the vehicle is stationary.

Referring now to FIG. 4 of the drawings, there is shown diagrammatically one possible arrangement of a control system for use with governors according to the present invention when applied to a vehicle, such as for example a diesel powered highway truck having one or more engine driven accessories such as an unloading pump, a concrete mixing barrel or the like.

In the disclosed system, an air line 127 from the vehicle air supply, not shown, supplies pressurized air through an inversion valve 128 to one side of a two-way check valve 130. A connection 132 with the parking brake permits the inversion valve 132 to conduct air only when the vehicle parking brake is engaged. Line 127 also supplies air through a transmission valve 134 to the other side of the two-way check valve 130. The transmission valve is arranged to conduct air only when the vehicle transmission is operating in its highest range. The check valve 130 is in turn connected with a pair of syncro valves 136 and 138, the latter having an air pressure regulator 140 intervening to permit operator control of the air pressure supplied to valve 138. This valve in turn supplies the regulated air through the opening 118 of governor 10' to the chamber 116 where it acts upon the speed adjusting piston 92 of the governor. The other syncro valve 136 is connected with the air cylinder 122 of the governor and supplies air thereto for actuating its plunger.

Both syncro valves include air actuated signal portions connected with a push pull control valve 142, which is in turn connected with the check valve 130. Neither of the syncro valves 136 and 138 will permit the passage of any air to the governor unless their signal portions are actuated by air pressure conducted through the push pull control valve, which is manually controlled by the operator. In addition, a line 144 from the vehicle service brake is arranged to shut off the push pull control valve when the service brake is actuated.

CONTROL SYSTEM OPERATION

The operation of the governor as installed in a vehicle with the control system shown in FIG. 4 is as follows.

When the vehicle is in motion, the system may be used as a road speed control at such time as the vehicle has reached highway speeds and is operating in its highest or direct driving gear. Shifting of the transmission into high gear opens the transmission valve 134, permitting air from the vehicle supply to pass to the syncro valves 136 and 138 and the push pull control valve 142. Actuation of valve 142 to the ON position supplies the required signal to the syncro valves, which then supply air pressure to the governor air cylinder 122 and the speed adjusting piston 92.

Energizing of the air cylinder 122 extends its plunger 124 which mechanically moves lever 50 into position to hold the manual throttle mechanism of the governor in the maximum fuel position. At the same time, the pressure of the air against piston 92 is controlled by the operator through actuation of the regulator 140 to control the governed speed of the engine and thereby the vehicle in the manner previously described with regard to operation of the governor. Thereafter, subject to slight variation with change in load, the governor will maintain the set speed which may be varied by the operator through adjustment of regulator 140 as long as the control mechanism remains in operation.

Such opertion may be terminated by manually shutting off the push pull control valve 142 or by applying the vehicle service brake which also shuts off valve 142. In addition, shifting of the vehicle to a lower gear will close the transmission valve 134 and cut off air to the control system. When any of these actions occurs, the pressurized air is exhausted from the governor connected mechanisms and the system returns to normal operation, with the operator having full control of engine speed through his manual throttle, while the governor returns to its normal mode of idle and maximum engine speed control.

When the system is used to control engine speed for auxiliary drive, the vehicle must be stopped and the parking brake set in order to permit air to be delivered through the inversion valve 128 and check valve 130 to the syncro valves 136 and 138. Actuation of the push pull control valve 142 then energizes the system so that the engine speed may be controlled by the operator through actuation of the pressure regulator 140. Operation in this mode will be discontinued at such time as the push pull control valve is shut off manually or by operation of the service brake, or if the parking brake is released.

While the invention has been described by reference to certain preferred governor arrangements and a specific control system for use with such governors, it should be understood that the inventive concepts disclosed are applicable to a much more diverse range of governor types and control systems than have been specifically disclosed herein. Accordingly, it is intended that the invention not be limited, except by the language of the following claims.

What is claimed is:

1. The combination of an engine governor of the type wherein a speed setting spring has one end fixed in a housing and another operative end effectively engaging and movable with fuel control means connected with speed responsive means that increasingly urge the fuel control means in a fuel decreasing direction as engine speed is increased, said spring being preloaded and yieldable above a predetermined force to permit fuel decreasing movement of the fuel control by the speed responsive means so as to control engine speed at a predetermined setting, and the improvement comprising: a speed adjuster effecive to controllably bias the operative end of the speed setting spring in a direction opposite to its preload force, said adjuster having a force applying element movable with and capable of acting upon the operative end of the spring and of being adjustably biased in relation to the housing to variably oppose the preload force of the spring on the speed responsive means, thereby variably and controllably reducing the effective speed setting of the governor.

2. The combinatin of claim 1 wherein said speed adjuster includes a fluid actuated piston operatively connected with the operative end of the speed setting spring and means defining a fluid chamber on one side of the piston wherein a pressurized fluid may be introduced that will act against the piston, creating thereon a biasing force directly proportional to the pressure of the fluid.

3. The combination of claim 2 and further comprising means for supplying air under pressure to the chamber and control means connected with said air supply means and operable to regulate the pressure of the air supplied to the chamber.

4. In combination with a mechanical engine governor having first actuating means movable between maximum and minimum fuel positions, second actuating means movable between first and second positions, said first and second actuating means being connected, at least during engine operating above idle speed, such that movement of said second means toward its first position moves said first means toward its maximum fuel position, a speed setting spring biasing said second means toward its first position over the full travel of said second means, engine speed responsive means connected with said second actuating means, at least during engine operation above idle, such that said speed responsive means applies a force against said second means, said force increasing as a function of increased engine speed and acting in a direction opposing the bias of said spring and, upon yielding of said spring, moving said first means toward its minimum fuel position, and the improvement comprising variable force applying means connected to apply an externally controlled variable force opposing the bias of said spring against said second actuating means, whereby the controlling speed setting of said governor is reduced in proportion as the variable force applied by said applying means is increased.

5. The combination of claim 4 wherein said variable force applying means comprises a piston operatively connected with said second means and means defining a chamber on one side of said piston wherein a pressurized fluid may be introduced that will act against said piston one side so as to create said externally controlled variable force.

6. The combination of claim 5 and further comprising means for supplying air under pressure to the chamber and control means connected with said air supply means and operable to regulate the pressure of the air supplied to the chamber.

* * * * *